US008403575B2

(12) United States Patent
Gocho

(10) Patent No.: US 8,403,575 B2
(45) Date of Patent: Mar. 26, 2013

(54) IMAGE RECORDING APPARATUS AND METHOD FOR DETERMINING A STATE OF A CUTTING DEVICE

(75) Inventor: Tomoko Gocho, Tokyo (JP)

(73) Assignee: Olympus Corporation, Tokyo (JP)

( * ) Notice: Subject to any disclaimer, the term of this patent is extended or adjusted under 35 U.S.C. 154(b) by 365 days.

(21) Appl. No.: 12/939,354

(22) Filed: Nov. 4, 2010

(65) Prior Publication Data

US 2011/0123245 A1 May 26, 2011

(30) Foreign Application Priority Data

Nov. 25, 2009 (JP) ..... 2009-268026

(51) Int. Cl.
*B41J 29/38* (2006.01)
*B41J 11/70* (2006.01)

(52) U.S. Cl. ..... 400/76; 400/621; 83/522.27

(58) Field of Classification Search ..... 400/621, 400/76; 83/522.27, 522.11, 522.12
See application file for complete search history.

(56) References Cited

U.S. PATENT DOCUMENTS 7,124,670 B2 * 10/2006 Tanaka et al. ..... 83/62

FOREIGN PATENT DOCUMENTS

| | | | |
|---|---|---|---|
| JP | 2001088384 A | * | 4/2001 |
| JP | 2005-059187 A | | 3/2005 |
| JP | 2005-161494 A | | 6/2005 |
| JP | 2010092214 A | * | 4/2010 |

* cited by examiner

*Primary Examiner* — Daniel J Colilla
(74) *Attorney, Agent, or Firm* — Holtz, Holtz, Goodman & Chick PC

(57) ABSTRACT

In an image recording apparatus, a record medium passage information generation unit detects a sheet passage state of a record medium after the continuous record media is cut. A control unit determines the state of a cutting device according to the passage time information between cut record media obtained from the sheet passage state of the cut record medium detected by the record medium passage information generation unit and predetermined time information.

10 Claims, 9 Drawing Sheets

| RECORD MEDIUM TYPE A | RECORD MEDIUM TYPE B | CONVEYING SPEED | STANDARD SHIELDING TIME Tn | STANDARD NON-SHIELDING TIME Ts | REPLACEMENT TIMING DETECTING NON-SHIELDING TIME Tc | PAPER JAM DETECTING NON-SHIELDING TIME Tj |
|---|---|---|---|---|---|---|
| A1 | B1 | V1 | Tn1 | Ts1 | Tc1 | Tj1 |
| | | V2 | Tn2 | Ts2 | Tc2 | Tj2 |
| | | V3 | Tn3 | Ts3 | Tc3 | Tj3 |
| | B2 | V1 | Tn4 | Ts4 | Tc4 | Tj4 |
| | | V2 | Tn5 | Ts5 | Tc5 | Tj5 |
| | | V3 | Tn6 | Ts6 | Tc6 | Tj6 |
| | B3 | V1 | Tn7 | Ts7 | Tc7 | Tj7 |
| | | V2 | Tn8 | Ts8 | Tc8 | Tj8 |
| | | V3 | Tn9 | Ts9 | Tc9 | Tj9 |
| A2 | ---------- | | | | | |
| A3 | ---------- | | | | | |
| An | ---------- | | | | | |

FIG. 8

IMAGE RECORDING APPARATUS AND METHOD FOR DETERMINING A STATE OF A CUTTING DEVICE

CROSS REFERENCE TO RELATED APPLICATION

This application is based upon and claims the benefit of priority from the prior Japanese Patent Application No. 2009-268026, filed Nov. 25, 2009, the entire contents of which are incorporated herein by reference.

BACKGROUND OF THE INVENTION

1. Field of the Invention

The present invention relates to an image recording apparatus for recording an image by fixing ink on a record medium such as a paper sheet, film, etc., and more specifically to a image recording apparatus and a method of controlling the image recording apparatus provided with a cutting unit for cutting the record medium.

2. Description of the Related Art

Conventionally well known is an image recording apparatus for recording an image by jetting ink on a roll of a paper sheet, film, etc. as a record medium (continuous record medium). The image recording apparatus can be provided with a cutting mechanism for cutting and ejecting each page of a record medium on which an image has been recorded.

When the cutting edge of the cutting unit of an image recording apparatus provided with a cutting mechanism for cutting a continuous record medium becomes poor in sharpness, the user replaces the cutting edge. Unless the user replaces the cutting edge with appropriate timing, a sufficiently sharp edge may be unnecessarily replaced too soon, or a dull edge may be continuously used, thereby causing a paper jam due to a bad cutting effect. Thus, the user incurs a disadvantage and the image recording apparatus can be damaged by the user neglecting to replace a cutting edge with appropriate timing.

To solve the above-mentioned problem, various types of technology of detecting the time for replacement of a cutting edge of a cutting unit and notifying a user of a detection result are proposed.

For example, the Japanese Laid-open Patent Publication No. 2005-161494 discloses the technology of comparing the current cutting frequency acquired by summing the cutting information obtained from an edge position sensor when a sheet is cut with the cutting frequency of replacement reference of a cutting edge registered in advance in a control unit. When the current cutting frequency exceeds the cutting frequency of replacement reference, it is determined that the cutting edge falls in the time for replacement and the user is notified of the timing.

The Japanese Laid-open Patent Publication No. 2005-59187 discloses the technology of an image recording apparatus having a cutting edge for cutting a record medium, and cutting the record medium by moving it in the width direction of the record medium. With the image recording apparatus, the time for replacement of a cutting edge is determined using a detection device (transmission photosensor etc.) for detecting the diagonal state of a record medium occurring when the record medium is cut by the friction at the cutting operation when the cutting capability of the cutting edge becomes degraded.

SUMMARY OF THE INVENTION

The image recording apparatus according to the present invention includes: a conveyance unit for conveying a continuous record medium according to the information from an higher-level device and having the conveyance information about the continuous record medium; a cutting unit having a cutting device for cutting the continuous record medium and a detection device for detecting the cutting position of the continuous record medium by the cutting device; an ejection unit for conveying the cut record medium; a record medium passage information generation unit for detecting the sheet passage state of the record medium after the continuous record medium is cut; and a control unit for determining the state of the cutting device according to the passage time information between cut record media obtained from the sheet passage state of the cut record medium detected by the record medium passage information generation unit and the predetermined time information.

In the method of controlling the image recording apparatus according to the present invention, the image recording apparatus includes: a conveyance unit for conveying a continuous record medium according to the information from an higher-level device and having the conveyance information about the continuous record medium; a cutting unit having a cutting device for cutting the continuous record medium and a detection device for detecting the cutting position of the continuous record medium by the cutting device; and an ejection unit for conveying the cut record medium, and the controlling method includes: detecting the sheet passage state of the record medium after the continuous record medium is cut; and determining the state of the cutting device according to the passage time information between cut record media obtained from the detected sheet passage state of the cut record medium and the predetermined time information.

BRIEF DESCRIPTION OF THE DRAWINGS

FIG. 8 is an example of a parameter table used when determining the cutting capability of the cutting unit according to the present invention.

DESCRIPTION OF THE PREFERRED EMBODIMENTS

The embodiments of the present invention are described below in detail with reference to the attached drawings. In the descriptions below a full line printer in the ink jet system is described as an example of the image recording apparatus according to the embodiments.

Figure 1:
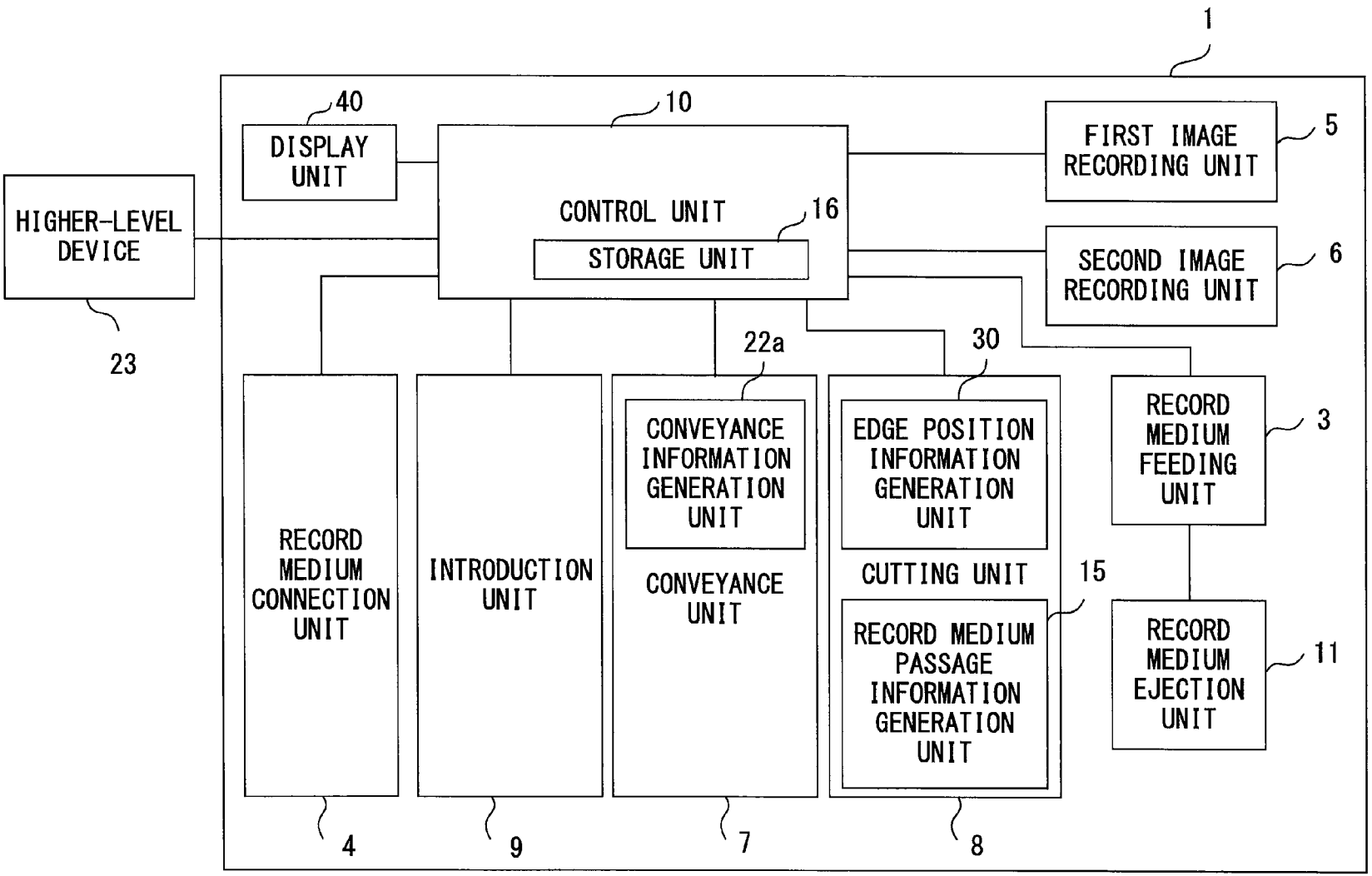
FIG. 1 is the entire configuration of the image recording apparatus according to an embodiment of the present invention.

FIG. 1 is the entire configuration of the image recording apparatus according to an embodiment. An image recording apparatus 1 illustrated in FIG. 1 is connected to a higher-level device 23 such as a personal computer (PC), and records an image on a continuous roll of continuous record medium 2 at an instruction from the higher-level device 23. In the descriptions below, the continuous record medium is referred to as a record medium for short. However, when a continuous record medium and a record medium in a predetermined size obtained by cutting a continuous record medium are to be discriminated, they are referred to as a "continuous record medium" and a "record medium" respectively.

The image recording apparatus 1 illustrated in FIG. 1 includes a record medium feeding unit 3, a record medium connection unit 4, a first image recording unit 5, a second image recording unit 6, a conveyance unit 7, a cutting unit 8, an introduction unit 9, a control unit 10, a record medium ejection unit 11, and a display unit 40.

The record medium feeding unit 3 rolls the record medium 2, and the record medium connection unit 4 relays the record medium 2. The first image recording unit 5 and the second image recording unit 6 record image on the right side and the reverse of the record medium 2 respectively.

The conveyance unit 7 conveys the record medium 2 according to the information input from the higher-level device 23. The conveyance unit 7 includes a conveyance information generation unit 22*a*, and conveys the record medium 2 on which the images are recorded by the first image recording unit 5 and the second image recording unit 6 by predetermined tension and speed. The conveyance information generation unit 22*a* is described below with reference to FIG. 2.

The cutting unit 8 includes a cutting edge, an edge position information generation unit 30, and a record medium passage information generation unit 15. The edge position information generation unit 30 detects the position at which the cutting edge of the cutting unit 8 cuts the record medium 2. The record medium passage information generation unit 15 detects the passage state of the continuous record medium 2 after it is cut by the cutting unit 8 at the predetermined position. The cutting unit 8 cuts a continuous record medium of a predetermined length by cutting the record medium 2 by the cutting edge at the position at which the edge position information generation unit 30 detects. The introduction unit 9 is arranged between the conveyance unit 7 and the cutting unit 8, and introduces the record medium 2 conveyed by the conveyance unit 7 to the cutting unit 8.

The record medium ejection unit 11 conveys the record medium 2 cut by the cutting unit 8, and ejects and stores the record medium 2.

The display unit 40 has a display, an LED, etc., and shows the status of the image recording apparatus 1, for example, the status of the record medium 2, the cutting unit 8, etc. to a user.

The control unit 10 determines the status of the cutting edge of the cutting unit 8 according to the information about the time relating to the passage of the record media 2 and predetermined information. The information about the time relating to the passage of the record media 2 is obtained based on the passage state of the record medium 2 detected by the record medium passage information generation unit 15. The control unit 10 determines the status etc. of the conveyance unit 7 etc. using the passage state of the record medium 2 detected by the record medium passage information generation unit 15. Otherwise, the control unit 10 controls each unit illustrated in FIG. 1 to record an image etc. on the record medium 2 and perform the conveyance etc. of a record medium. Since these processes are well known techniques, the detailed description is omitted here.

Figure 2:
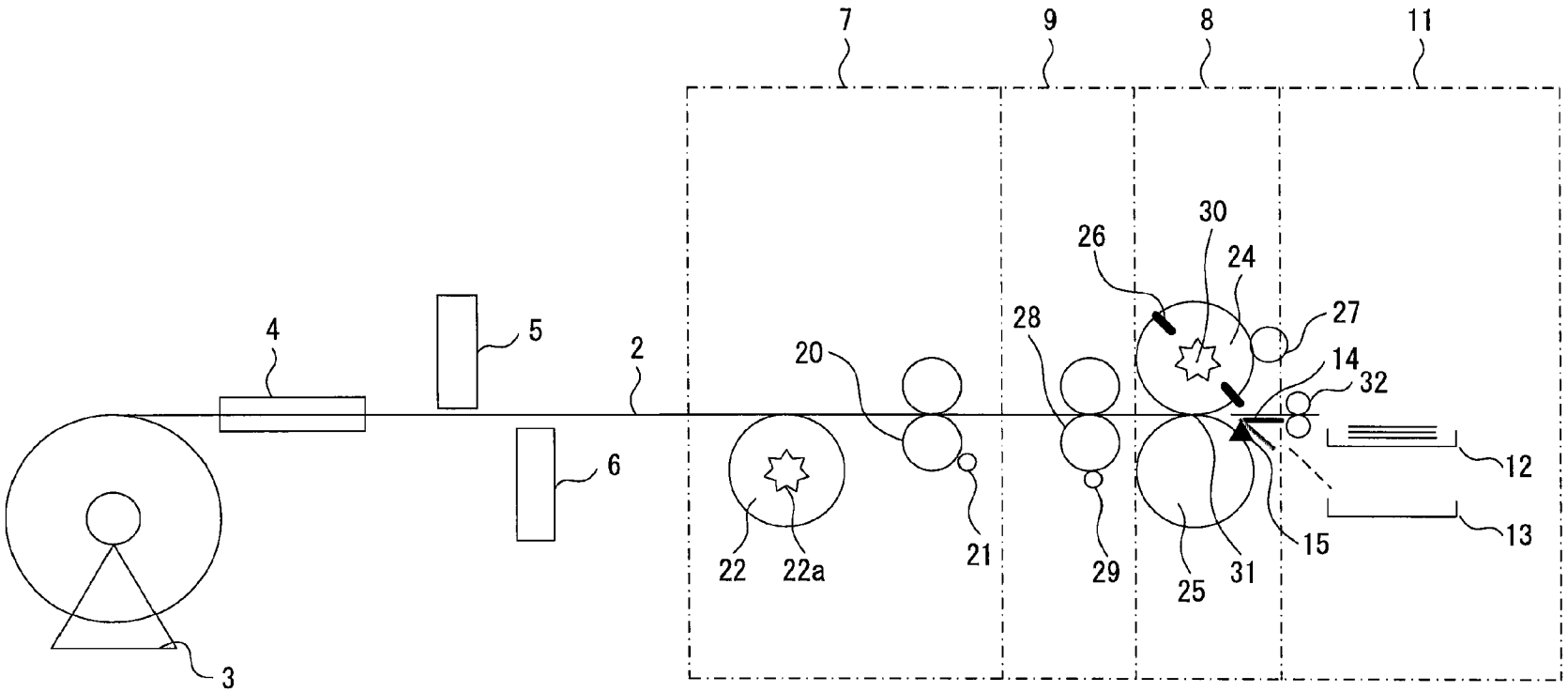
FIG. 2 is a schematic diagram of the image recording apparatus according to an embodiment of the present invention.

FIG. 2 is a schematic diagram of the image recording apparatus 1 according to an embodiment. The detailed configuration of the image recording apparatus 1 according to the present embodiment, and the operations with the configuration are described below with reference to FIG. 2.

As illustrated in FIG. 2, the record medium ejection unit 11 for storing the record medium 2 cut by the cutting unit 8 is provided at the subsequent stage of the cutting unit 8. The record medium ejection unit 11 is provided with a record medium stacker 12 for storing the record medium 2 on which an image is recorded and a discarded medium stacker 13 for discarding unnecessary record medium 2. The switch between the stacker 12 and 13 which is to eject record medium 2 is performed by a switch plate 14.

On the other hand, the unit is also provided with a nip roller pair 20 for holding the record medium 2 and conveying the record medium 2 downstream. The nip roller pair 20 is driven by a nip roller drive motor 21. The conveyance unit 7 has a roller 22 rotating according to the conveyance of the record medium 2, and the roller 22 is provided with the conveyance information generation unit 22*a* for detecting the amount of conveyance of the record medium 2. The conveyance information generation unit 22*a* is configured by, for example, an encoder.

The cutting unit 8 is arranged to cut the record medium 2 so that a cutting roller 24 as a cutting rotor rotating at a predetermined rotation speed can face an anvil roller 25 as a receiving rotor. A cutter edge 26 is provided on the outer periphery of the cutting roller 24, and cuts the record medium 2.

The cutting roller 24 has a cutting roller drive motor 27 as a driving source. The cutting roller drive motor 27 uses the conveyance information generated by the conveyance information generation unit 22*a* as a control pulse, and establishes the synchronization between the conveying speed of the record medium 2 and the peripheral speed of the cutter edge 26.

An encoder can be attached to the cutting roller drive motor 27 to synchronize the conveying speed of the record medium 2 with the peripheral speed of the cutter edge 26 according to an encoder signal.

The introduction unit 9 is arranged between the conveyance unit 7 and the cutting unit 8. The medium conveyance tension of the introduction unit 9 holds the record medium 2, and is lower than the tension in the conveyance unit 7. The introduction unit 9 is provided with a cutter supply roller pair 28 as a pair of rotors for introducing the record medium 2 to the cutting unit 8. The cutter supply roller pair 28 is driven by a cutter supply roller drive motor 29.

In addition, the record medium ejection unit 11 is provided with an ejection roller pair 32, conveys the record medium at a conveying speed higher than the speed when the record medium is cut so that the record medium is not impose an excess load, and ejects the record medium to the predetermined record medium stackers 12 and 13.

The processing operation of the image recording apparatus 1 with the above-mentioned configuration is described below. As described above, the control unit 10 receives an image record instruction from the higher-level device 23 such as a personal computer (PC) etc. and performs driving control on each component of the image recording apparatus 1, that is, the first image recording unit 5, the second image recording unit 6, the conveyance unit 7, the cutting unit 8, and the introduction unit 9.

First, the record medium 2 is attached to the record medium feeding unit 3 in the state of a roll as described above. A back tension is applied to the roll of the record medium 2 by the friction applying mechanism not illustrated in the attached drawings.

The nip roller pair 20 conveys the record medium 2 to the first image recording unit 5 while maintaining a constant conveying speed of the record medium 2. Then, the first image recording unit 5 performs an image recording process on the surface of the record medium 2. The record medium 2 is further conveyed, and the second image recording unit 6 performs an image recording process on the reverse of the record medium 2.

In the present embodiment, the above-mentioned cutting unit 8 of the rotary type is used in a method of cutting a continuous record medium for each predetermined print unit. The cutter edge 26 is pushed against the anvil roller 25 by rotating the cutter edge 26 of the cutting unit 8 at the constant peripheral speed in synchronization with the conveying speed of the record medium 2, and cuts the record medium 2 in a predetermined size.

An edge position information generation unit 30 is provided for detecting the position of the cutter edge 26 on the drive axis of the cutting roller 24. The edge position information generation unit 30 is configured by, for example, an absolute encoder. When the attachment position of the cutter edge 26 is the position of the origin of the absolute encoder, the periphery length from the current position of the cutter edge 26 to the next cut position can be obtained from the entire peripheral length of the cutting roller 24 and the resolution of the absolute encoder.

Figure 3:
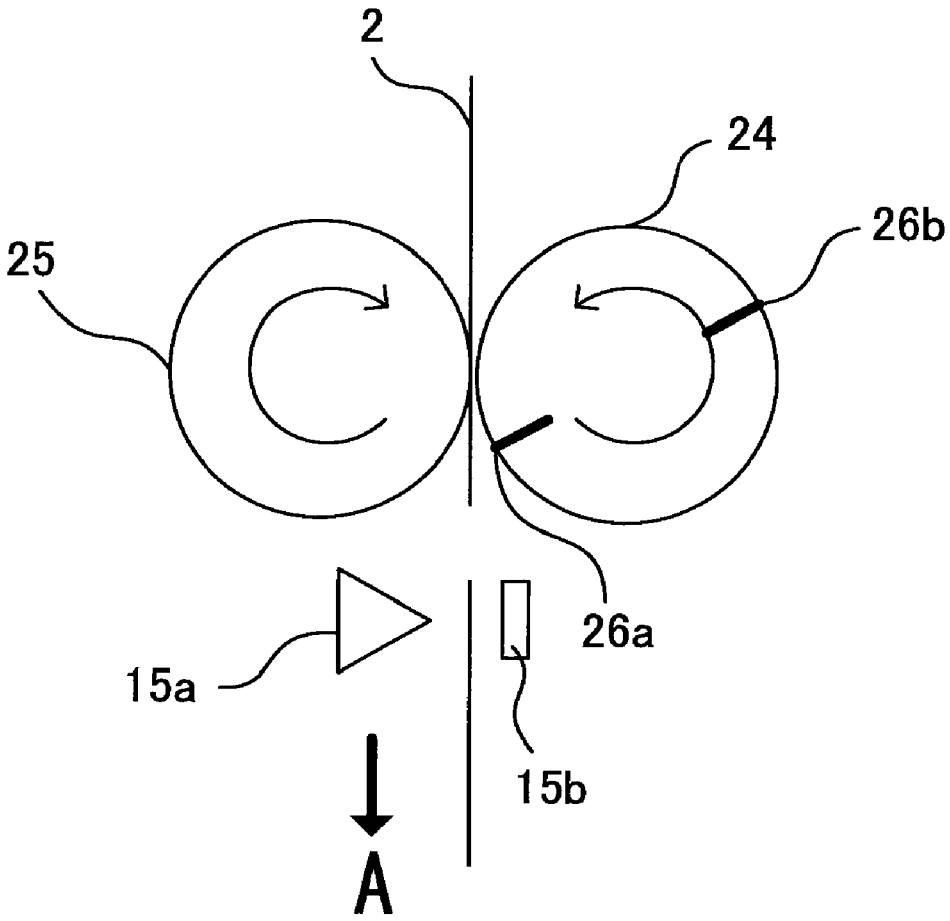
FIG. 3 is a configuration of the cutting unit according to the present invention.

In FIG. 3, a cutting edge 26*a* is attached at the position corresponding to the origin of the absolute encoder (edge position information generation unit 30) on the periphery of the cutting roller 24. With the configuration illustrated in FIG. 3, a cutting edge 26*b* is attached opposite the cutting edge 26*a* about the drive axis of the cutting roller 24.

The cutting roller 24 and the anvil roller 25 have a larger inertial force than the nip roller pair 20, and rotate at a predetermined constant speed. The record medium 2 is cut by the introduction between the cutting roller 24 and the anvil roller 25. The record medium 2 is cut for the length of the distance of the movement while the cutting roller 24 performs one rotation. Since two cutting edges (26*a* and 26*b*) are attached to the cutting roller 24 in the present embodiment, two sheets are cut by one rotation of the cutting roller 24.

To detect whether or not the cut record medium 2 is conveyed to the record medium ejection unit 11 at an appropriate speed, the record medium passage information generation unit 15 is provided downstream the cutting roller 24. The record medium passage information generation unit 15 is configured by, for example, a transmission photosensor, and arranged so that light emitting and receiving device pair 15*a* and 15*b* are positioned on opposite sides of the conveyance path as illustrated in FIG. 3. Thus, the state whether the record medium 2 shields the sensor or not can be detected.

That is, the passage time (sensor shielding time) of a sheet of a record medium cut for a predetermined length, and the time taken from the passage of the previous cut sheet to the conveyance of the next cut sheet, that is, the sheet interval time (sensor non-shielding time) are detected.

When the cutting capability of the cutter edge 26 is sufficiently acceptable, the record medium passage information generation unit 15 generates the shielding and non-shielding states at predetermined time intervals. The intervals can be determined for standard timing depending on the conveying speed, the type and the length of the record medium 2.

In the descriptions below, the standard value of the sensor shielding time as the passage time of the record medium 2 is defined as a "standard shielding time", and the standard value of the sensor non-shielding time as a sheet interval time is defined as a "standard non-shielding time".

Figure 4:
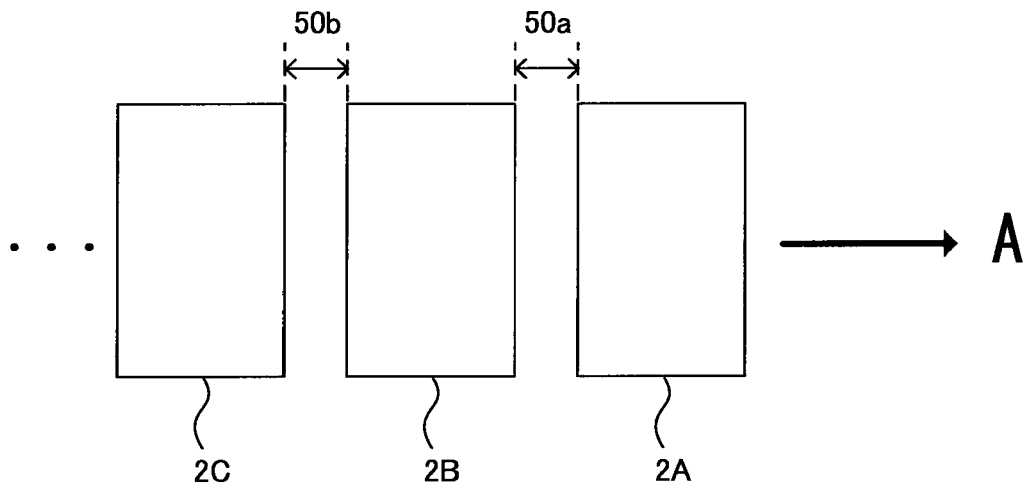
FIG. 4 is an explanatory view of the cut state of a record medium when the cutting capability of the cutting edge is high according to the present invention.
Figure 5:
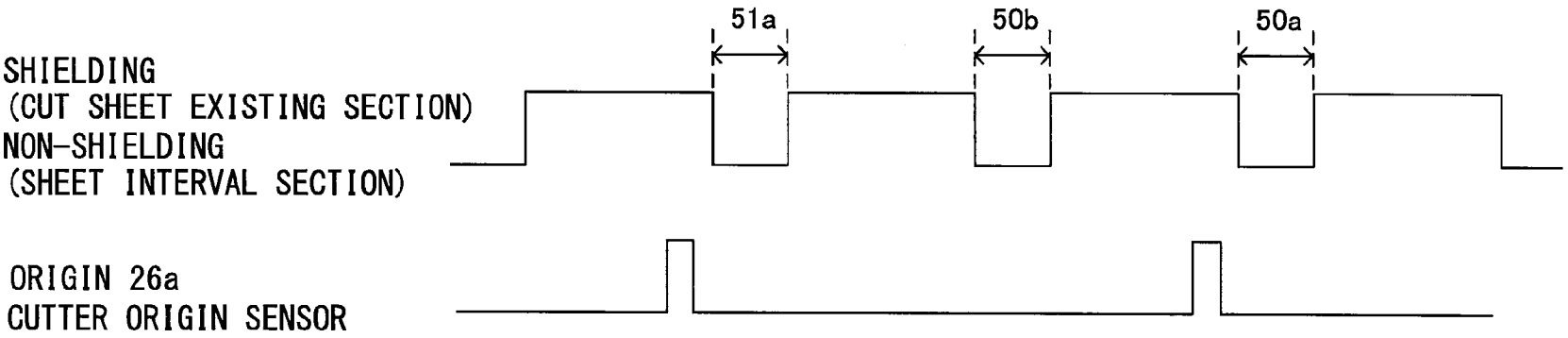
FIG. 5 is an explanatory view of the record medium passage information generation unit when the cutting capability of the cutting edge is high according to the present invention.

FIG. 4 is an explanatory view of the cut state of the record medium 2 when the cutting capability of the cutting edge 26 is high. FIG. 5 is an explanatory view of the record medium passage information generation unit 15 when the cutting capability of the cutting edge 26 is high. In FIGS. 4 and 5, the cutting roller 24 is provided with two cutting edges 26*a* and 26*b* at the periphery of the cutting roller 24 as illustrated in FIG. 3. The cutting edge 26*a* is attached at the position corresponding to the origin of the absolute encoder (edge position information generation unit 30), and the record medium 2 is conveyed in the direction A of the arrow as illustrated in FIG. 4. The record medium is conveyed toward the record medium ejection unit 11 in the order of the record media 2A, 2B, and 2C.

As illustrated in FIGS. 4 and 5, the cutting roller 24 rotates at a predetermined speed in synchronization with the conveying speed of the record medium 2. Therefore, when the cutting capability of the cutter edge 26 is high, the lengths of the intervals of the sheets cut by the cutting edge 26*a* and the cutting edge 26*b* are substantially the same. An interval 51*a* between the sheets cut by the cutting edge 26*a* is substantially the same as the interval 50*a*.

The origin sensor of the absolute encoder (edge position information generation unit 30) is positioned at the cutting edge 26*a*, and it is determined using the origin sensor whether the interval of the sheets is made by the cutting edge 26*a* or the 26*b*.

On the other hand, when the cutting capability of the cutter edge 26 becomes degraded, a sheet cannot be correctly cut off the continuous record medium, and the interval between a preceding medium and a subsequent medium can be shorter or inconstant. It indicates that the time of the non-shielding state is shorter than a standard time although there is no great difference from the standard time as at the occurrence of a medium jam, or an unstable state between the shielding time and the non-shielding time continues in the record medium passage information generation unit 15.

Figure 6:
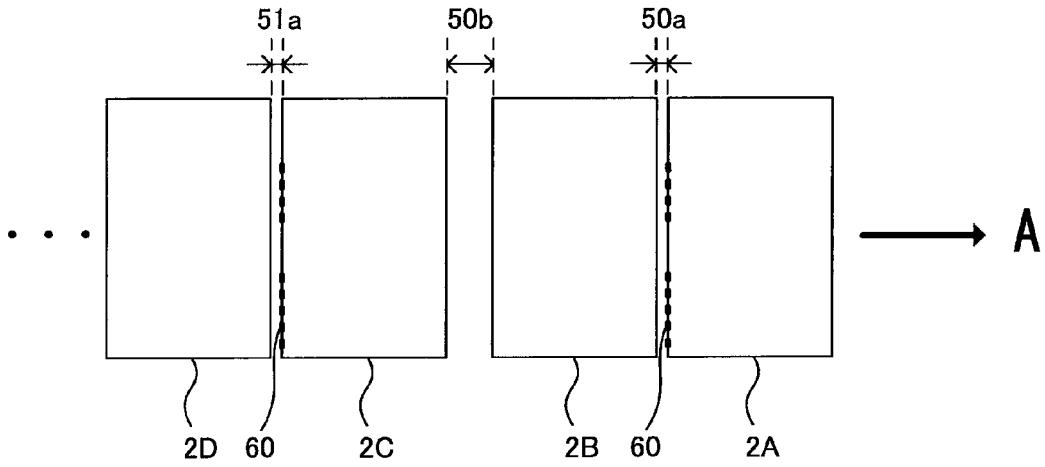
FIG. 6 is an explanatory view of the cut state of a record medium when the cutting capability of the cutting edge becomes degraded according to the present invention.
Figure 7:
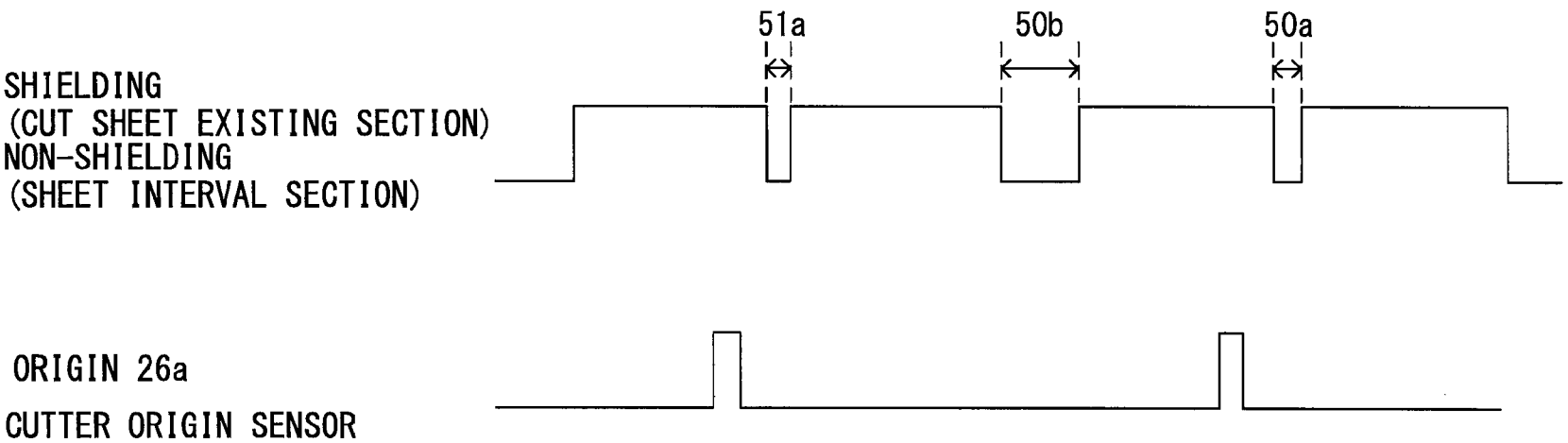
FIG. 7 is an explanatory view of the record medium passage information generation unit when the cutting capability of the cutting edge becomes degraded according to the present invention.

FIG. 6 is an explanatory view of the cut state of the record medium 2 when the cutting capability of the cutting edge 26 becomes degraded. FIG. 7 is an explanatory view of the record medium passage information generation unit 15 when the cutting capability of the cutting edge 26 becomes degraded. In this example, between the two cutting edges 26*a* and 26*b* provided for the cutting roller 24, the cutting capability of the cutting edge 26*a* becomes degraded and the time for replacement approaches.

As illustrated in FIGS. 6 and 7, when the record medium is cut by the cutting edge 26*a* whose cutting capability has become degraded, a faulty cut portion 60 exists. Thus, the interval between the cut sheets (for example, 50*a* and 51*a* in FIG. 6) is shorter than the sheet interval (50*a* in FIG. 4 etc.) when no problem exists in the cutting capability illustrated in FIGS. 4 and 5.

Then, when the image recording apparatus 1 according to the present embodiment detects the above-mentioned state by the record medium passage information generation unit 15 of the cutting unit 8, it determines that it is the time for replacement of the cutter edge 26 and notifies the display unit 40 of the information. When a plurality of cutting edges are attached to the periphery of the rotary cutter, the information about which non-shielding time has become shorter that the standard non-shielding time is determined by measurement with respect to an origin signal of the cutter. According to the information about what number of non-shielding time is shorter than the standard non-shielding time, it can be determined and designated which cutter edge 26 has been degraded in cutting capability in the plurality of cutter edges 26.

The image recording apparatus 1 according to the present embodiment is provided with a table to set in the table the standard shielding time and the standard non-shielding time for each type of the record medium 2. The table is stored in a non-volatile storage unit 16 in the control unit 10 as illustrated in FIG. 1.

FIG. 8 is an example of a parameter table used when determining the cutting capability of the cutting unit 8. As illustrated in FIG. 8, the conveying speed V, the standard shielding time Tn, the standard non-shielding time Ts, the replacement timing detecting non-shielding time Tc, and the paper jam detecting non-shielding time Tj of a record medium are set for each of the record medium 2 (record medium type A and B).

The standard shielding time and the standard non-shielding time are set for each type of sheet (record medium 2) and for each sheet size in the present embodiment. That is, the type of the sheet such as a coated paper, a plain paper, etc. is set in the record medium type A, and A3, A4, a letter size, etc. can be set in the record medium type B.

For example, when an image is recorded on a plain paper of A4, the image recording apparatus 1 receives from the higher-level device 23 the information about the type and size of the sheet, searches the table illustrated in FIG. 8, and acquires the information about a "plain paper" as the record medium type A and "A4" as the record medium type B. From the acquired information, necessary information such as the standard shielding time Tn, the standard non-shielding time Ts, etc. is retrieved for use in each determination. Thus, the image recording apparatus 1 according to the present embodiment can appropriately detect the state of the cutter edge 26 during the cutting operation and the state of a paper jam etc. depending on the type of the record medium 2 on which an image is recorded and the cutting size.

As necessary, the information about the thickness of a sheet can be added to the parameter table.

The standard shielding time Tn indicates the time in which the record medium passage information generation unit 15 is shielded by the record medium 2. The standard shielding time Tn is calculated according to a plurality of conveying speeds V (V1, V2, V3, etc. in the example illustrated in FIG. 8) determined depending on the type of sheet (record medium type A), and the sheet size (record medium type B), that is, the length in conveyance direction.

The standard non-shielding time Ts is set based on the standard time of the sheet interval when the cutter edge 26 having a high cutting capability is used. As described above, when the cutting capability of the cutter edge 26 is becoming degraded, the interval between the record media 2 (sheet interval) is shorter than the standard sheet interval by unsuccessful cutting of a part of the record medium 2 or a prolonged time required to cut the medium. Therefore, in the present embodiment, the replacement timing detecting non-shielding time Tc is set, and when the measured non-shielding time is shorter than the Tc, it is determined that the cutting capability of the cutter edge 26 has degraded.

In the present embodiment, assume that the standard shielding time (standard passage time) about the type and size of a sheet is 800 ms and the standard non-shielding time (standard sheet interval time) Ts is, for example, 100 ms. It is also assumed that the non-shielding time (sheet interval time) Tc used in detecting the replacement timing of the cutter edge 26 in the case above is 50 ms. Assume that the non-shielding time (sheet interval time) Tj (<Tc) is 10 ms. The magnitude relation between the non-shielding time Tc and Tj is described later in detail.

If the non-shielding time (sheet interval time) t1 detected by the record medium passage information generation unit (sensor) 15 is in the range of Tc<t1<Ts, then it is assumed that the cutting capability of the cutter edge 26 and the paper jam state are in the normal state.

If the non-shielding time t1 is in the range of Tj<t1<Tc, it is determined that the life of the cutter edge 26 is over. If it is in the range of t1<Tj, it is determined that it indicates the sign of a jam of the record medium 2.

As described above, a time shorter than the standard non-shielding time Ts is set as the replacement timing detecting non-shielding time Tc because the distance between cut sheets becomes shorter and the sheet interval time becomes shorter than the standard non-shielding time Ts when the cutting capability of the cutter edge 26 is degraded as described with reference to FIGS. 6 and 7.

In addition, as described above, a time further shorter than the replacement timing detecting non-shielding time Tc for determination of the replacement timing of the cutter edge 26 is set as the paper jam detecting non-shielding time Tj for detection of a paper jam. It is caused for the following reason. That is, when it is likely to cause a paper jam, the distance between cut sheets is further shorter by the overlay of sheets etc. than when the record medium 2 cannot be correctly cut by the degradation of the cutting capability of the cutter edge 26.

When a non-shielding state is continued for a time longer than the standard non-shielding time Ts, that is, when Ts is shorter than t1 (Ts<t1), it is determined that a paper jam occurs on the conveyance path. It is caused by no shielding with the record medium on the record medium passage information generation unit 15 by a paper jam and the stagnant record media on the preceding path before the record medium reaches the record medium passage information generation unit 15.

When there is the relationship of t2>Tn between the shielding time t2 and the standard shielding time Tn detected by the record medium passage information generation unit 15, it is determined that there occurs a paper jam of the cut record media 2 on the conveyance path.

Thus, the passage time and the sheet interval time of the sheets cut by the cutter edge 26 are compared with the standard passage time (standard shielding time Tn), the sheet interval time (standard non-shielding time Ts), the replacement timing detecting non-shielding time Tc, and the paper jam detecting non-shielding time Tj. Thus, the cutting capability of the cutter edge 26, a paper jam, and its sign can be detected without providing a special mechanism or means.

Figure 9:
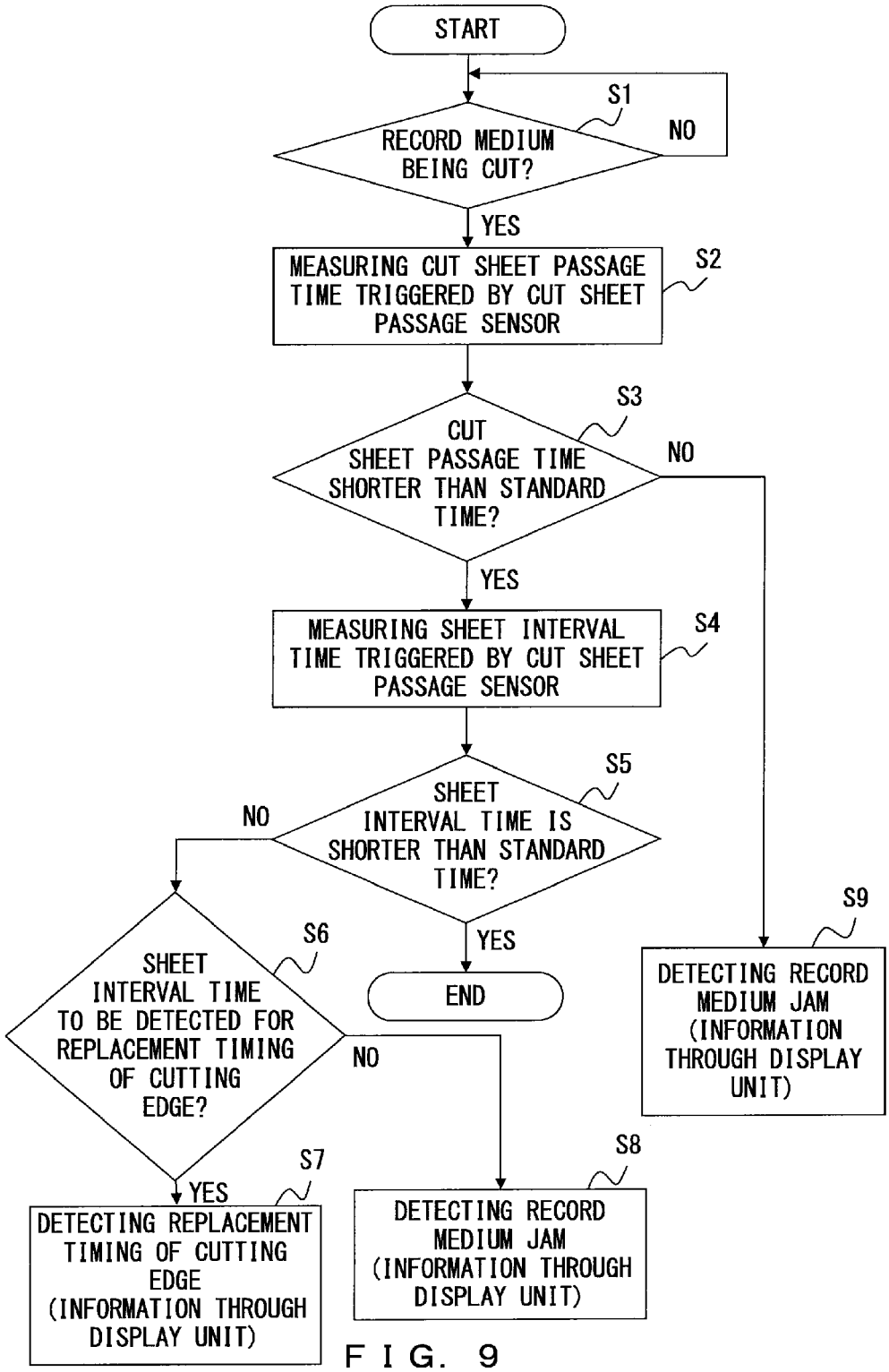
FIG. 9 is a flowchart of the process performed by the image recording apparatus according to an embodiment of the present invention.

FIG. 9 is a flowchart of the process performed by the image recording apparatus 1 according to the present embodiment. The method of the image recording apparatus 1 according to the present embodiment determining the time for replacement of the cutter edge 26, and a paper jam and its sign using the non-shielding time t1, that is, the sheet interval time, and the shielding time t2 detected by the record medium passage information generation unit 15 is described below with reference to FIG. 9.

First, in step S1, the start of cutting the record medium 2 is awaited, and when the cutting of the record medium 2 is started, control is passed to step S2. In step S2, by the trigger of the detection of the cut sheet 2 by the sensor 15 as a record medium passage information generation unit, the time (shielding time t2) required for the cut sheet which is cut by the cutter edge 26 to pass over the sensor 15 is measured.

In step S3, the passage time t2 of the cut sheets measured in step S2 is compared with the standard shielding time Tn, and it is determined whether or not the passage time of the cut sheets is equal to or shorter than the standard shielding time. If the passage time t2 of the cut sheets exceeds the standard shielding time Tn, control is passed to step S9, and it is determined that there has occurred a jam of the record media 2. Then, the user is notified that there has occurred a jam of the record media 2 through the display unit 40, thereby terminating the process.

If it is determined in step S3 that the passage time t2 of the cut sheets is equal to or shorter than the standard shielding time Tn, then control is passed to step S4. By the trigger of no detection of the cut sheet 2 by the sensor 15, the time until the detection of the next cut sheet after the passage of the current cut sheet, that is, the sheet interval time (non-shielding time t1), is measured.

In step S5, the sheet interval time t1 measured in step S4 is compared with the standard non-shielding time Ts, and it is determined whether or not the sheet interval time t1 is equal to or shorter than the standard non-shielding time Ts. If the sheet interval time t1 is equal to or shorter than the standard non-shielding time Ts, then it is determined that the cut sheets are normally cut, thereby terminating the process.

If it is determined in step S5 that the sheet interval time t1 exceeds the standard non-shielding time Ts, then control is passed to step S6. The sheet interval time t1 measured in step S4 is compared with the standard non-shielding time (Tc, Tj) to determine the replacement timing of the cutter edge 26 and a paper jam. In the embodiment, as described above with reference to FIG. 8, the replacement timing detecting non-shielding time Tc for detection of the replacement timing of the cutter edge 26, and the paper jam detecting non-shielding time Tj for detection of a paper jam are used for comparison with the sheet interval time.

If it is determined in step S6 that the sheet interval time is equal to or longer than the paper jam detecting non-shielding time Tj and is equal to or shorter than the replacement timing detecting non-shielding time Tc, then control is passed from step S6 to step S7. In step S7, the replacement timing of the cutter edge 26 is detected, and the user is notified through the display unit 40 that the replacement timing of the cutter edge 26 approaches, thereby terminating the process.

If it determined in step S6 that the sheet interval time is shorter than the paper jam detecting non-shielding time Tj or exceeds the standard non-shielding time Ts, then control is passed from step S6 to step S8. In step S8, the jam of the record media 2 is detected, and the user is notified through the display unit 40 that there has occurred the jam of the record media, thereby terminating the process.

As described above, according to the image recording apparatus 1 of the present embodiment, the record medium passage information generation unit 15 detects the passage state of the record media (cut sheets) obtained by cutting the continuous record medium 2 by the cutting unit 8, thereby obtaining the time required for the passage etc. The time when the cutting capability of the cutting edge (cutter edge 26) of the cutting unit 8 is high is predetermined for each type and conveying speed of the record medium, stored in the image recording apparatus 1, and compared with the obtained time. The predetermined time is based on the required time when a cut sheet passes through the record medium passage information generation unit 15, and the standard time of the sheet interval time among the cut sheets. When the cutting capability of the cutting edge is degraded, the degradation of the cutting capability of the cutting edge is detected and the replacement timing of the cutting edge can be informed without providing special means or mechanism by using the fact that the sheet interval time of the cut sheets has become shorter.

Similarly, a paper jam and its sign can also be detected by comparing the obtained sheet interval time of the record media 2 with the standard sheet interval time etc. of an occurrence of a paper jam and its sign.

In the descriptions above, an example of a transmission photosensor is described as an embodiment of the sensor of the record medium passage information generation unit 15, but the present invention is not limited to this example. For example, a reflective photosensor can be used.

In addition, in the descriptions above, two cutter edges 26 are used for the cutting roller 24, but it is obvious that the configuration is not limited. By recognizing the number of cutting edges provided for, the control unit 10 of the image recording apparatus 1 can calculate the position from the origin in the edge position information generation unit 30. Thus, when it is determined that there is a cutting edge whose cutting capability has been degraded in a plurality of cutter edges 26, it can be determined which cutter edge 26 is to be replaced.

The type of cutter is described with reference to a rotary cutter in the embodiment above, but the present invention is not limited to this type. That is, a cutter of guillotine type, laser type, etc. can be used.

Furthermore, the present invention is not limited to the above-mentioned embodiment, but the components can be varied and embodies within the scope of the gist of the present invention in the embodying stage. In addition, the present invention can be realized by various embodiments by appropriately combining a plurality of components disclosed by the embodiments above. For example, some components can be deleted from the entire components used in the embodiments above, and different components in each embodiment can be appropriately combined.

What is claimed is:

1. An image recording apparatus, comprising;

a conveyance unit conveying a continuous record medium according to information from a higher-level device and having conveyance information about the continuous record medium;

a cutting unit having a cutting device for cutting the continuous record medium and a detection device for detecting a cutting position of the continuous record medium by the cutting device;

an ejection unit conveying the cut record medium;

a record medium passage information generation unit detecting a sheet passage state of the record medium after the continuous record medium is cut; and a control unit determining a state of the cutting device according to (i) passage time information between cut record media obtained from the sheet passage state of the cut record medium detected by the record medium passage information generation unit and (ii) predetermined time information.

2. The apparatus according to claim 1, wherein the record medium passage information generation unit detects a passage time in which the cut record medium passes and a sheet interval time of the cut record media indicating a time required until a next cut record medium starts passing after the cut record medium has passed, obtained from the detected sheet passage state, as the passage time information of the cut record medium.

3. The apparatus according to claim 2, wherein:

the sheet interval time has a first sheet interval time and a second sheet interval time shorter than the first sheet interval time;

the control unit determines a time for replacement of the cutting device when the sheet interval time of the cut record media detected by the record medium passage information generation unit is in a range between the first sheet interval time and the second sheet interval time.

4. The apparatus according to claim 3, wherein the controller determines that a paper jam has occurred in a conveyance path of the conveyance unit when it is detected that the sheet interval time of the cut record media detected by the record medium passage information generation unit is shorter than the second sheet interval time.

5. The apparatus according to claim 4, further comprising a unit informing of a sign of a paper jam or a unit informing of the sign of the paper jam and stopping conveyance of the record medium when it is determined that the paper jam has occurred.

6. The apparatus according to claim 1, wherein the control unit determines that the cut record media have caused a paper jam in a conveyance path of the conveyance unit when a passage time of the cut record medium detected by the record medium passage information generation unit is longer than a predetermined time.

7. A method of controlling an image recording apparatus, wherein:

the image recording apparatus comprises:

a conveyance unit conveying a continuous record medium according to information from a higher-level device and having conveyance information about the continuous record medium;

a cutting unit having a cutting device for cutting the continuous record medium and a detection device for detecting a cutting position of the continuous record medium by the cutting device; and an ejection unit conveying the cut record medium; and the controlling method comprises:

detecting a sheet passage state of the record medium after the continuous record medium is cut; and determining a state of the cutting device according to (i) passage time information between cut record media obtained from the detected sheet passage state of the cut record medium and (ii) predetermined time information.

8. The method according to claim 7, wherein the detecting comprises detecting, as the passage time information of the cut record medium, a passage time in which the cut record medium passes and a sheet interval time of the cut record media indicating a time required until a next cut record medium starts passing after the cut record medium has passed, obtained from the detected sheet passage state.

9. The method according to claim 8, wherein the sheet interval time has a first sheet interval time and a second sheet interval time shorter than the first sheet interval time, and wherein the method further comprises determining a time for replacement of the cutting device when the sheet interval time of the cut record media is in a range between the predetermined first sheet interval time and the second sheet interval time.

10. The method according to claim 7, further comprising:

determining that the cut record media have caused a paper jam in a conveyance path of the conveyance unit when a passage time of the cut record medium is longer than a predetermined time.

* * * * *